US008997824B2

(12) United States Patent
Walker

(10) Patent No.: US 8,997,824 B2
(45) Date of Patent: Apr. 7, 2015

(54) SOLAR SHUTTER

(76) Inventor: Brent Walker, Encinitas, CA (US)

( * ) Notice: Subject to any disclaimer, the term of this patent is extended or adjusted under 35 U.S.C. 154(b) by 22 days.

(21) Appl. No.: 13/423,070

(22) Filed: Mar. 16, 2012

(65) Prior Publication Data

US 2013/0239483 A1 Sep. 19, 2013

Related U.S. Application Data

(60) Provisional application No. 61/453,322, filed on Mar. 16, 2011.

(51) Int. Cl.

| | |
|---|---|
| ***A47H 1/00*** | (2006.01) |
| ***E06B 3/32*** | (2006.01) |
| ***A47H 23/02*** | (2006.01) |
| ***E06B 7/09*** | (2006.01) |
| ***E06B 9/24*** | (2006.01) |

(52) U.S. Cl.

CPC *E06B 7/09* (2013.01); *A47H 23/02* (2013.01); *A47H 2023/025* (2013.01); *E06B 9/24* (2013.01); *Y10T 29/49826* (2013.01); *Y10T 29/49947* (2013.01); *Y10T 29/4995* (2013.01)

(58) Field of Classification Search

USPC ..... 160/104, 327, 330, 89–91, 96, 97; 49/74.1, 77.1

See application file for complete search history.

(56) References Cited

U.S. PATENT DOCUMENTS

| | | | | | |
|---|---|---|---|---|---|
| 71,778 | A | * | 12/1867 | Miles | 160/104 |
| 2,755,524 | A | * | 7/1956 | Honer | 49/82.1 |
| 5,398,436 | A | * | 3/1995 | Suzuki | 40/558 |
| 5,820,189 | A | * | 10/1998 | Tew | 296/26.11 |
| 6,119,756 | A | * | 9/2000 | Tatro | 160/107 |
| 8,091,281 | B1 | * | 1/2012 | Blachley | 49/74.1 |
| 2002/0043349 | A1 | * | 4/2002 | Rigby et al. | 160/135 |
| 2004/0031572 | A1 | * | 2/2004 | Huang et al. | 160/89 |
| 2011/0303370 | A1 | * | 12/2011 | Dollard | 160/84.01 |

* cited by examiner

*Primary Examiner* — Blair M Johnson
*Assistant Examiner* — Jeremy Ramsey
(74) *Attorney, Agent, or Firm* — Timothy W. Fitzwilliam

(57) ABSTRACT

A window covering specially designed and attached to indoor residential shutters is disclosed. The window cover is removably attached by various means in various embodiments and provides a user with more control over light transmission, solar transmission and view through properties, as desired. In a preferred embodiment, holes are drilled into as shutter at respective corner. Subsequently, circular magnets are provided to each of the holes to mate with ferromagnetic material configured to the window covering. A variety of fabrics and color options are additionally provided to the window covering.

7 Claims, 9 Drawing Sheets

SOLAR SHUTTER

PRIORITY CLAIM

This patent application contains subject matter claiming benefit of the priority date of U.S. Provisional Patent Application Ser. No. 61/453,322 filed on Mar. 16, 2011 and entitled, SOLAR SHUTTER, accordingly, the entire contents of this provisional patent application is hereby expressly incorporated by reference.

BACKGROUND OF THE INVENTION

1. Field of the Invention

The present invention pertains generally to devices and methods for improving comfort and ambiance in domestic homes in addition to saving energy. More particularly, the invention relates to novel devices for solar screening to indoor shutters providing optimum lighting, privacy and climate control.

2. Description of the Prior Art

Window coverings for privacy and light control have been known in various forms and designs. One relatively common form of window covering consists of vertical or horizontal slats usually made from metal or vinyl, also referred to as "blinds." More specifically, Venetian blinds are a well liked design for regulating light and air in which horizontal (or vertical) slats are coupled by a chord and can rotate in unison nearly 180 degrees.

Several designs for window coverings have been proposed by Toti including U.S. Pat. No. 7,222,655, entitled "Window Covering System," which was awarded patent protection in 2006. According to Toti, over the past several years, pleated shade system have become popular form of window treatment. One version of a pleated shade system is made available from Versol USA, Inc. under the trademark RIDEAU, utilizes a prepleated fabric with strong, permanently set pleats that pack very tightly. Toti further suggests that this and related designs are problematic in that the pleats retain residual tension much like a spring.

A more recent example employs a suction means to a window covering for attachment directly to a window, according to U.S. Pat. App. No. 2010/0116447, entitled "Blind for A Window," to Thompson. In this example, the inventor seems to be most concerned with convenience and less concerned about whether the solution is aesthetically pleasing. Another example was set forth in U.S. Pat. No. 7,059,482, entitled "Window Covering Sample Display Device and Method," to Reid et al, that was also awarded patent protection in 2006. Therein, window coverings are attached directly to their windows via suction cups mounted to a rear of the device. Further according to Reid and his co-inventors, the past several decades have been marked by tremendous growth in the types of window covering materials that are available to purchasers. Starting with roller shades and slatted horizontal blinds, the field of window coverings has blossomed to include a wide array of different types of coverings. These have included pleated shades, Roman shades, cellular shades and many others.

Also known to window coverings are shutters, or interior shutters more particularly. Interior shutters have horizontal louvers or slats to control sun light, air flow, visibility etc. Typically, the louvers or slats have their collective angle controlled by a tilt bar. Additionally, interior shutters may hinge on either side of a window so that they can be opened to allow full light access. Most interior designers would consider these shutters to be aesthetically pleasing to the inside environment providing a plantation or European style atmosphere.

One problem with indoor shutters is that they can provide an annoying glare even when fully closed due to light rays through cracks. Also, as with some other forms of window coverings, lines of glare, such as that on a television or computer screen, can be annoying even when sun light is less than its peak intensity.

Accordingly, it is an object of the present invention to provide a window covering system to shutters that artfully combines the hard look of a shutter with the soft elegance of fabric. It is a further object of the present invention to provide a window covering system wherein many different fabrics could be chosen to provide a variety of pattern/color options as well as different light and solar transmission, and view through properties. It is still further an object of the present invention to provide a window covering system that can be easily manipulated and changed based on the particular desires of a user at a particular time. It is yet further an object of the present invention to provide a window covering for interior shutters that is relatively easy to manufacture and comparatively cost effective.

BRIEF SUMMARY OF THE INVENTION

The present invention specifically addresses and alleviates the above mentioned deficiencies associated with the prior art. More particularly, the present invention in a first aspect, is directed to an improved window shutter comprising: a four-sided frame for positioning about a window frame; a plurality of slats rotatably coupled to the frame, the plurality of slats having an open position and a closed position; and a covering fabric, removably coupled to the frame, the covering fabric providing at least a partial filter for light transmission through the window shutter.

The invention in the first aspect is additionally characterized wherein the four-sided frame comprises an outer frame and an inner frame, wherein the inner frame is hingedly connected to the outer frame and wherein the covering fabric is removably coupled to the inner frame. Also, when the plurality of slats are in the fully open position then the covering fabric is taut; and further when the plurality of slats are in the closed position then the covering fabric is slacked.

Further in a preferred embodiment, hook and loops fasteners are provided across a top and a bottom edge of the covering fabric to secure the fabric to the top and bottom of the four-sided frame. Alternatively, just the top portions of each have the hook and loop fasteners and the bottom fasteners are omitted. In a separate preferred embodiment, magnetic material is coupled to the frame; and corresponding material attracted to the magnetic material at a top (and optionally at bottom) edge of the covering fabric. In still another preferred embodiment, four holes are drilled at respective corners of the frame; four circular magnets each at a respective of the four holes; and a pair of ferromagnetic hem bars sewn into a respective top and a bottom of the covering fabric, wherein each of the pair corresponds to two of the four circular magnets. (or alternatively, four corresponding ferromagnetic pieces coupled to the covering fabric, or just two magnets are needed at approximately upper corners of the frame).

In yet still another preferred embodiment, the covering fabric removably coupled to the frame comprises: a first rigid, yet bendable rod configured a top of the covering fabric; an elongated sleeve configured snugly over the first rod, the elongated sleeve having a pair of loops at an upper portion thereof; and a pair of hooks coupled to an upper frame portion, the pair of hooks corresponding to the pair of loops on the elongated sleeve. In still further another preferred embodiment, the covering fabric removably coupled to the frame further comprises: first and second rigid, yet bendable rod configured to a top and a bottom of the covering fabric, respectively, the first and second rods each having loops approximately at opposing ends thereof; and four hooks corresponding to the loops at opposing ends of the first and second rigid, yet bendable rods.

In still another way of attaching the fabric to the shutter frame, a plurality of groves are configured to an edge of each of the plurality of slats; and a plurality of spline teeth are coupled to the covering fabric and each of the plurality of spline correspond to one of each of the plurality of grooves.

In a second aspect, the invention may be characterized as a method for enhancing and adding versatility to a window shutter comprising the steps of: providing a window shutter having a four-sided frame and including a plurality of slats; choosing a fabric based on a desired light transmission specification and aesthetically pleasing pattern and color; removably attaching the fabric to an upper area of the four-sided frame, wherein the fabric is taut when the plurality of slats are in an open position.

The method herein for enhancing and adding versatility to a window shutter is additionally characterized wherein the step of removably attaching the fabric to an upper area of the four-side frame further comprises the additional steps of: drilling two holes to the upper area of the four-sided frame; screwing in ferromagnetic material to each of the two holes; folding over a top of the fabric to form a sleeve at said top; sliding a magnetic hem bar into the sleeve; and attaching the magnetic hem bar in the sleeve to the ferromagnetic material in each of the two holes.

In a separate preferred embodiment the step of removably attaching the fabric to an upper area of the four-side frame further comprises the additional steps of: attaching a plastic magnetic holder having a magnet to the upper area of the four-sided frame; folding over a top of the fabric to form a sleeve at said top; sliding a ferromagnetic hem bar into the sleeve; and attaching the ferromagnetic hem bar in the magnet in the upper area of the four sided frame.

In still another separate preferred embodiment the step of removably attaching the fabric to an upper area of the four-side frame further comprises the additional steps of: attaching two hooks to the upper area of the four-sided frame; providing a long cylindrical drapery rod at a top of the fabric folding over the top of the fabric over the drapery rod; sliding an elongated sleeve over the over the top of the fabric and over the top of the drapery rod; and providing two loops at a top of the elongated sleeve corresponding to the tow hooks; and attaching said two loops to said two hooks.

These, as well as other advantages of the present invention will be more apparent from the following description and drawings. It is understood that changes in the specific structure shown and described may be made within the scope of the claims, without departing from the spirit of the invention.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF THE PREFERRED EMBODIMENTS

Various inventive features are described below that can each be used independently of one another or in combination with other features.

Figure 1:
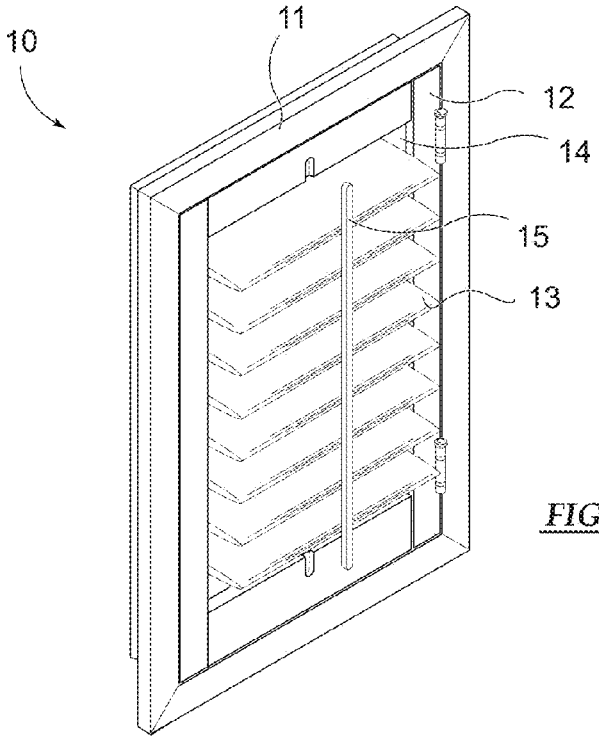
FIG. 1 is a perspective view of a window cover configured to a hinged interior shutter of the present invention.
Figure 2:
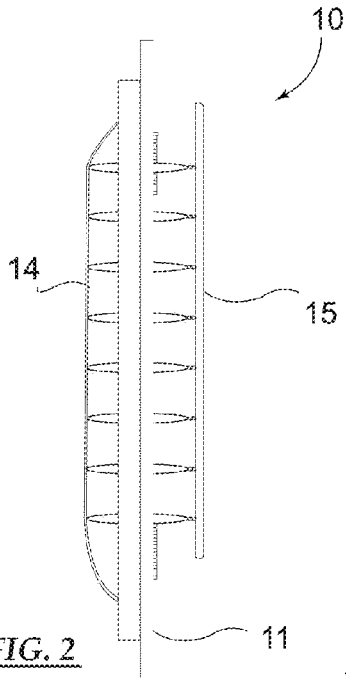
FIG. 2 is a profile view thereof.

Initially, with reference to FIG. 1, a preferred device and system of the present invention is illustrated in perspective. Illustrated is a window shutter 10 having a four-sided frame 11 configured to position a window frame 12, a plurality of slats 13 rotatably coupled to the window frame 12. As shown the slats 13 are fully open and light is filtered through a window covering 14 of the present invention. With regard to FIG. 2 a profile view is shown with the louvers/slats 13 fully open. Importantly, the slats 13 touch the window covering 14 such that they cause the covering 14 to be taut in the open position. If not for this, the covering 14 would be more difficult to see through. Further, the window covering 14 does not impede shutter 10 operation to any degree. The coverings 14 comprise high quality textured fabric providing a soft elegance to the traditional hard look of an interior shutter. Vertical link bar 15 is provided to adjust louver 13 position.

Figure 3:
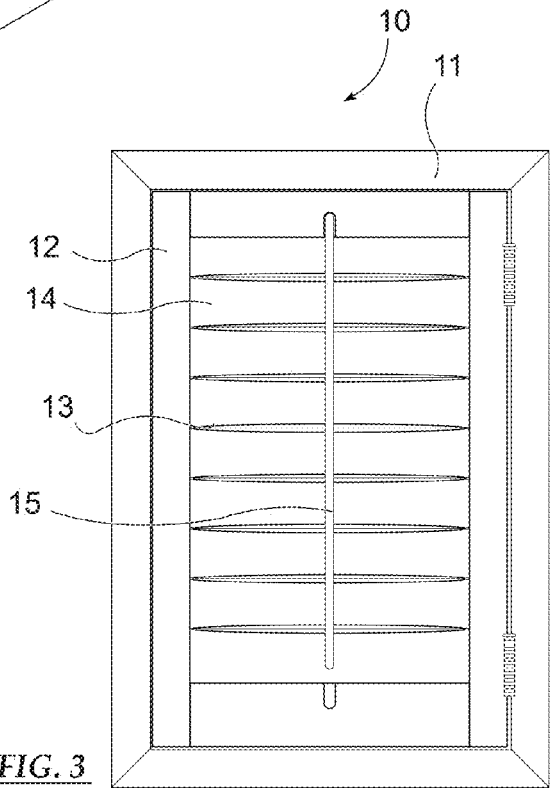
FIG. 3 is a front plan view of the first preferred embodiment of the present invention.
Figure 4:
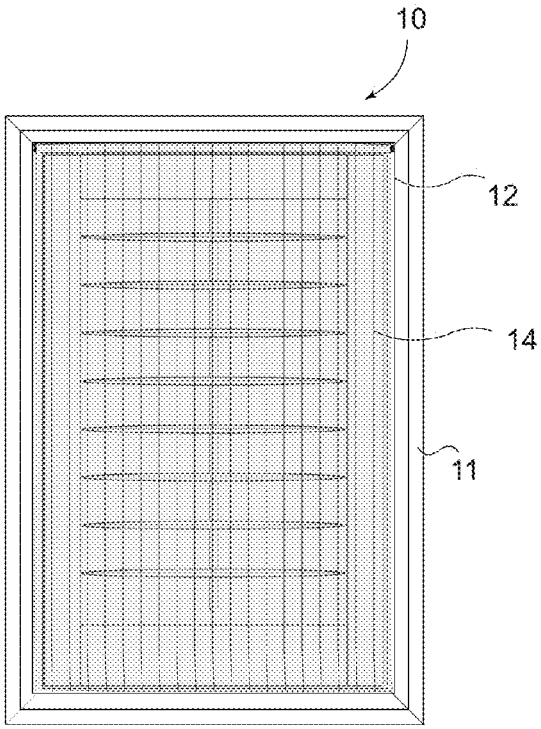
FIG. 4 is a rear plan view of the first preferred embodiment.

FIG. 3 illustrates a frontal view of the first preferred invention embodiment of the window shutter 10. As further shown herein, various coverings 14 having different colors and screening properties are optional to a user. For example, a minimum or maximum solar transmission may be optimal depending upon summer or winter seasonal weather conditions. Further, light transmission properties would depend on the amount of natural light desired by the user based on subjective preference. FIG. 3 along with FIG. 4 additionally show the visual pass though properties of a particular window covering 14.

Figure 5:
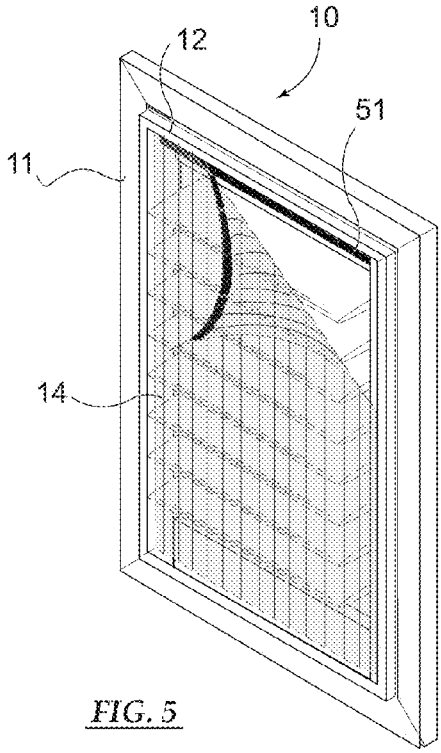
FIG. 5 is a rear perspective view of the preferred embodiment shown with the window covering partially removed.

FIG. 5 is a rear perspective view of the preferred embodiment shown with the window covering 14 partially removed. A means for attachment is provided comprising hook and loop fasteners 51 (such as VELCRO®) on the inner frame 12. The window covering 14 has a corresponding hook and loop fastener 52 to couple with the hook and loop fasteners 51 on the inner frame 12.

Figure 6:
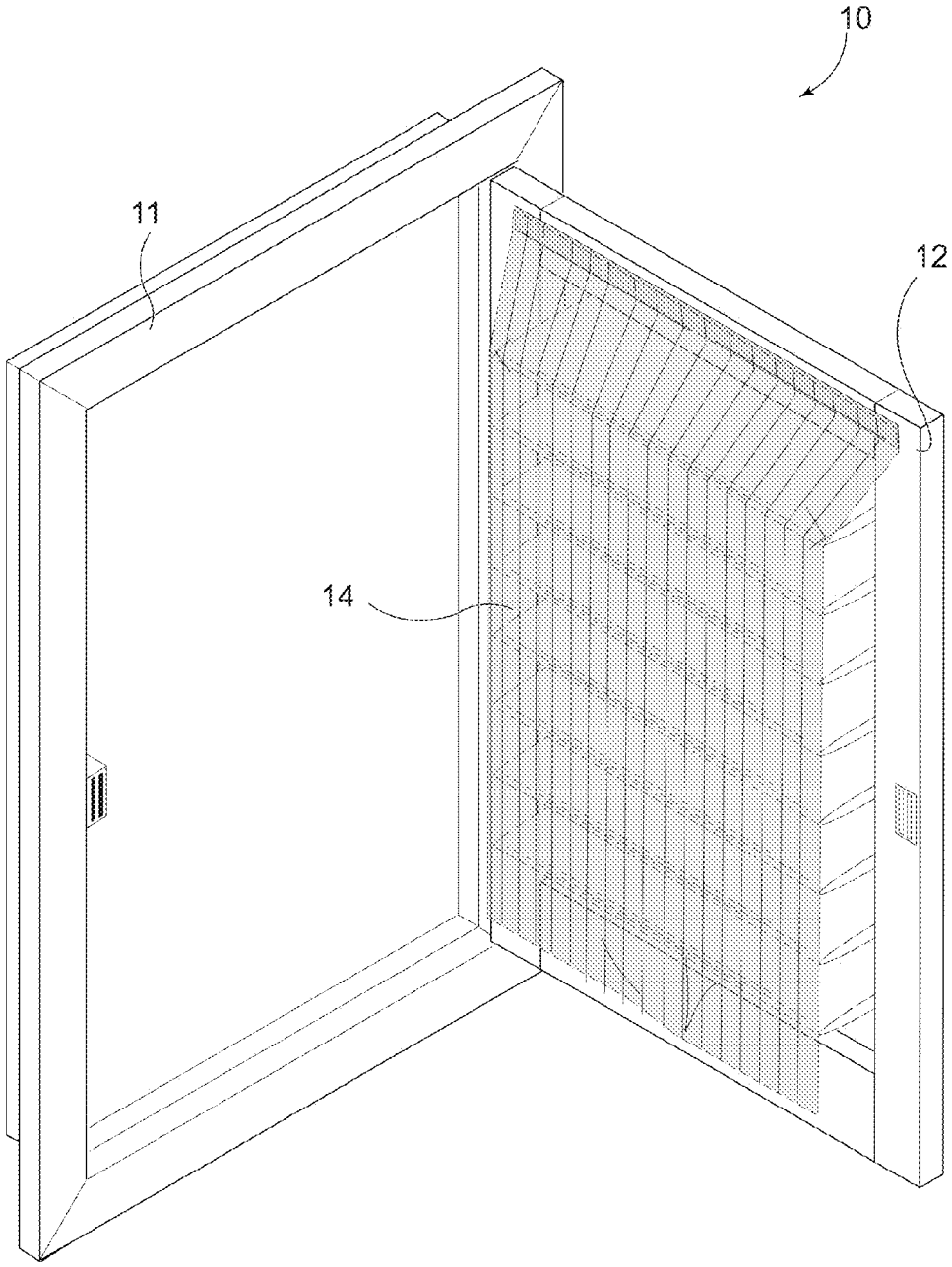
FIG. 6 is a perspective illustration of a hinged interior shutter employing a window covering of the present invention.

FIG. 6 is an additional perspective view illustrating how a covering 14 of the present invention will not affect indoor shutter operation of the present invention. Further as shown, the cover 14 could be easily removed and replaced with another having a different color, pattern, light, or solar transmission properties. The solar shutter system comprises an indoor shutter 10 to be configured to a window frame 11, the indoor shutter 10 further comprising an outside frame 10 11 hingedly coupled to an inside frame 12, the inside frame 12 comprising louvers 13, and a window covering 14 removably attached to upper and lower portions of the inside frame 12.

Figure 7A:
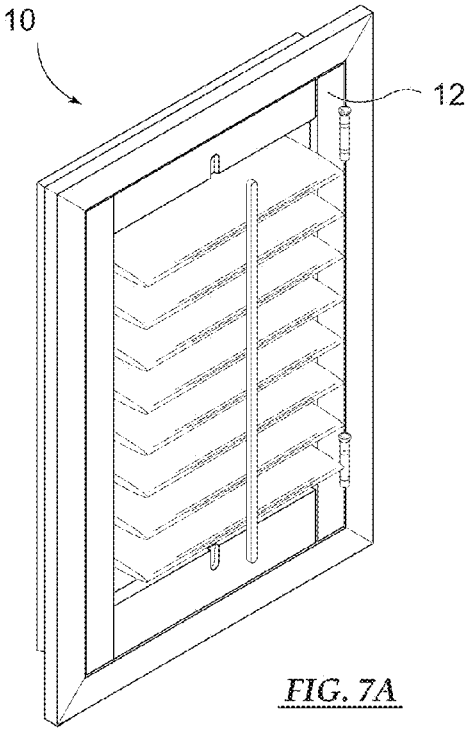
FIG. 7A is an additional perspective illustration of a shutter without an optional hinge.
Figure 7B:
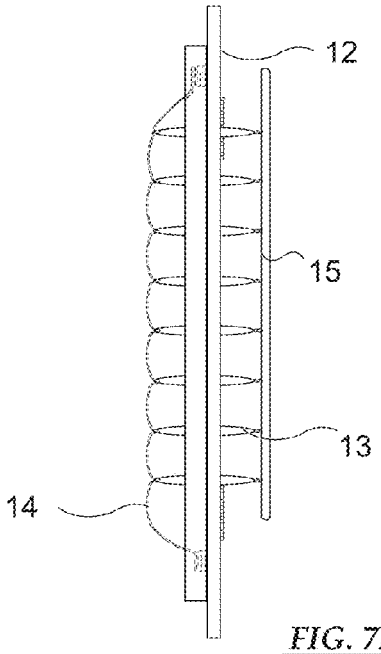
FIG. 7B is a profile view of a second preferred embodiment of the present invention.
Figure 7C:
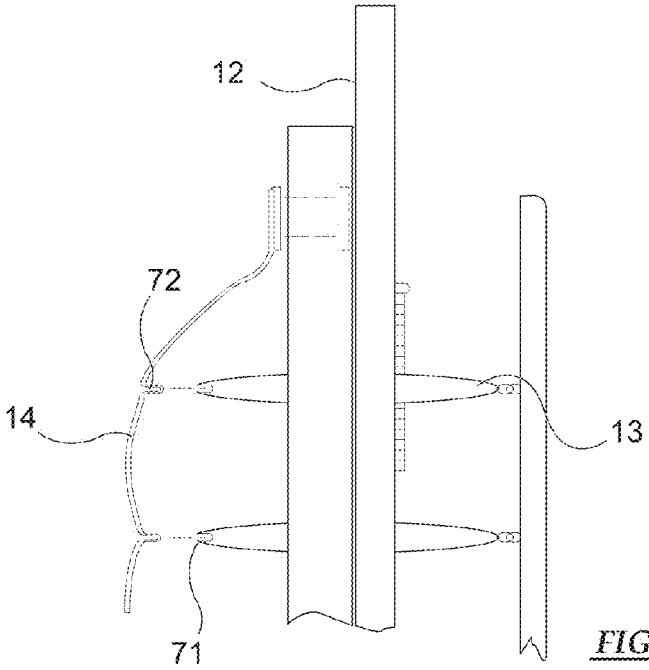
FIG. 7C is an enlarged and exploded view thereof.

FIG. 7A shows an additional perspective illustration of a shutter 10 without an optional hinge; while FIG. 7B is a profile view of a second preferred embodiment of the present invention. Herein, the window covering fabric 14 is coupled to upper and lower portions of the shutter inside frame 12, and additionally to each of the louvers 13 along an edge thereof. One method of attachment illustrated in FIG. 7C involves providing grooves to an edge of the plurality of louvers 13. Next, the grooves are mated to a plurality of spline teeth configured to the fabric 14, as shown.

With regard to FIG. 8A through FIG. 8F, an additional solar shutter embodiment is illustrated in its construction and use. Initially, a rigid yet bendable clear plastic rod 81 is provided to a filter fabric 14. Closer inspection of the filter fabric 14 in this embodiment reveals that it comprises wide bands separated by thin lines, the wide bands and thin lines further comprise different filtering properties. It is specifically contemplated that providing different patterned filters would be visually pleasing to a user.

Figure 8A:
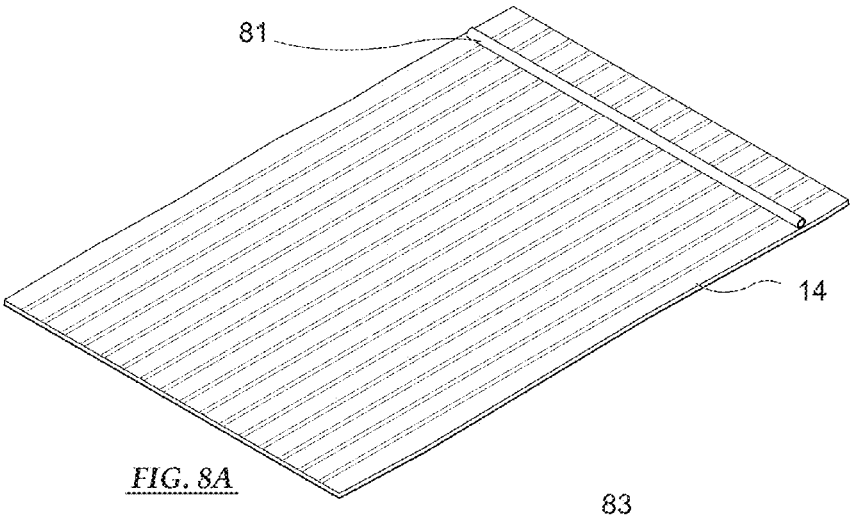
FIGS. 8A through 8F illustrate an additional embodiment showing its construction and intended use.
Figure 8B:
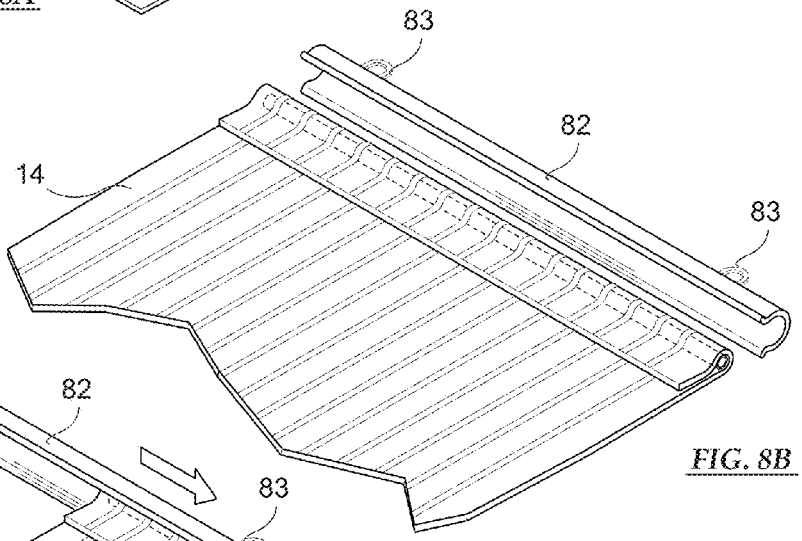
Figure 8C:
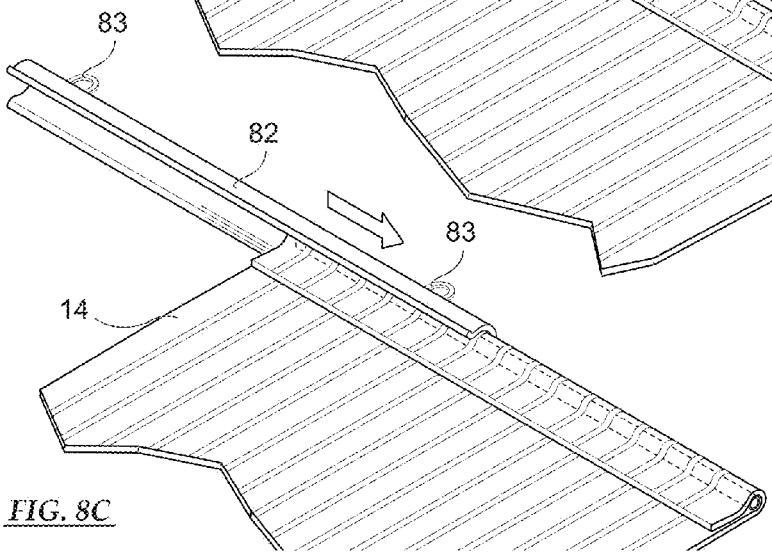
Figure 8D:
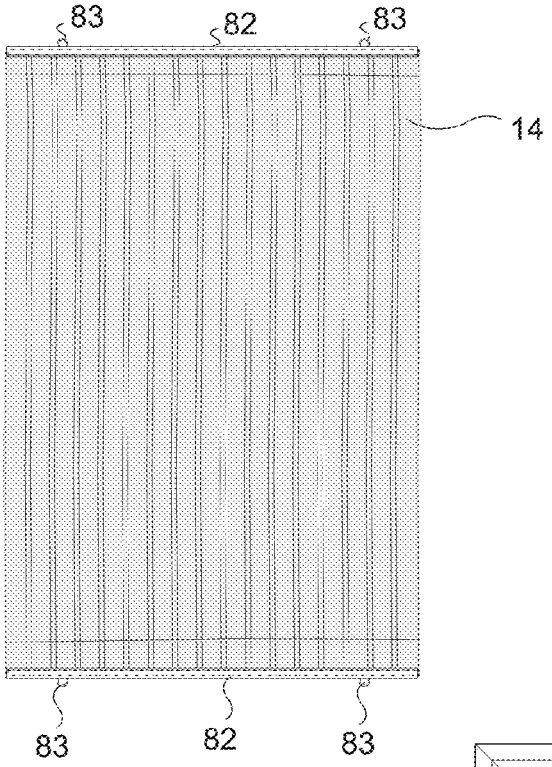
Figure 8E:
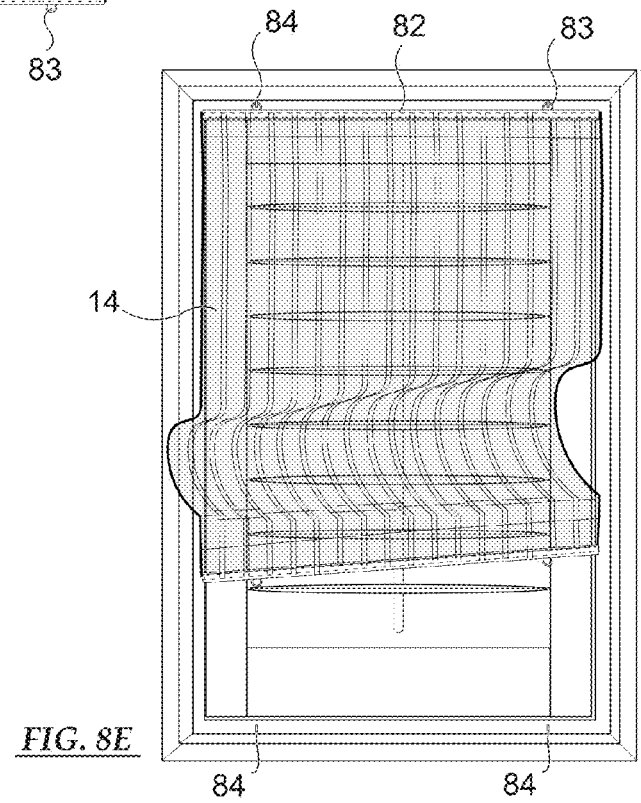
Figure 8F:
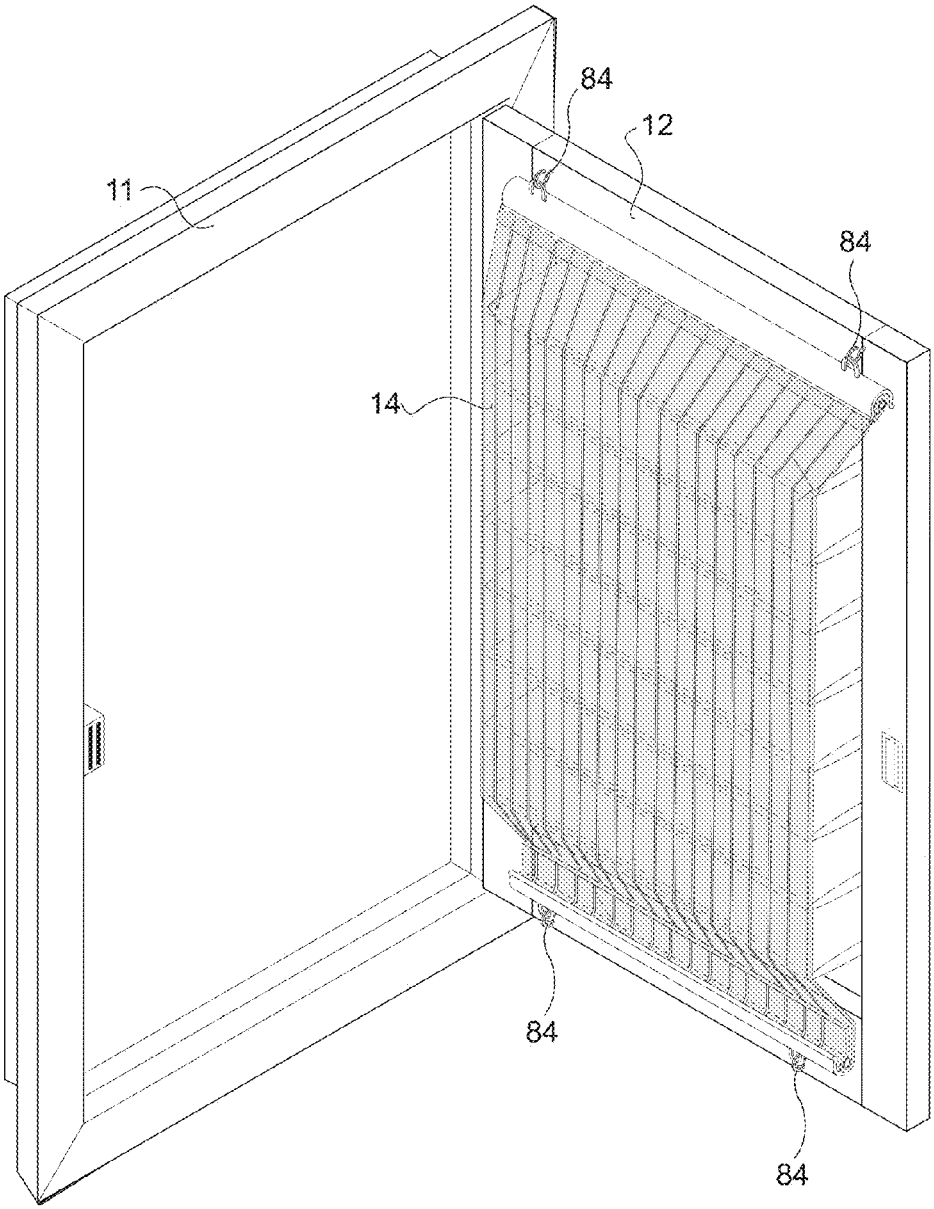

Further to the solar shutter construction, the patterned filter fabric 14 is folded over the clear plastic rod 81 as shown in FIG. 8B. Next a sleeve 82 is provided slidingly over the rod 81 as illustrated in FIG. 8C. This particular arrangement allows for adjustability so that the exact size is not fixed. Additionally, rings 83 are provided to the sleeve 82 to be coupled to hooks 84 of the present invention as shown in FIG. 8D through FIG. 8F. Yet further, the sleeve 82 has a groove in a top portion thereof wherein the rings 83 slide within the grove, also providing adjustability to the present invention. FIG. 8F shows this particular embodiment in use coupled to an inner frame 12.

Figure 9A:
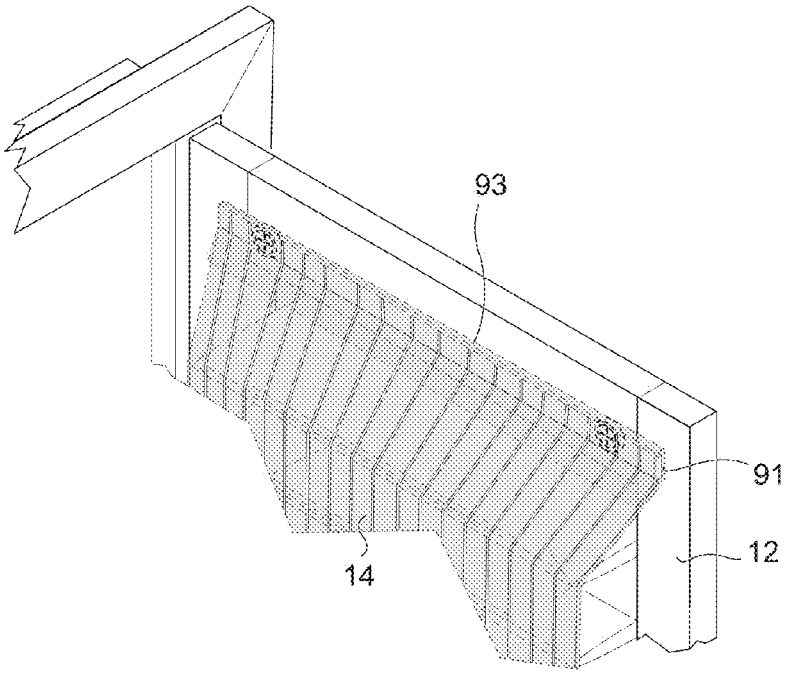
FIGS. 9A through 9C illustrate an alternative embodiment of the window covering.
Figure 9B:
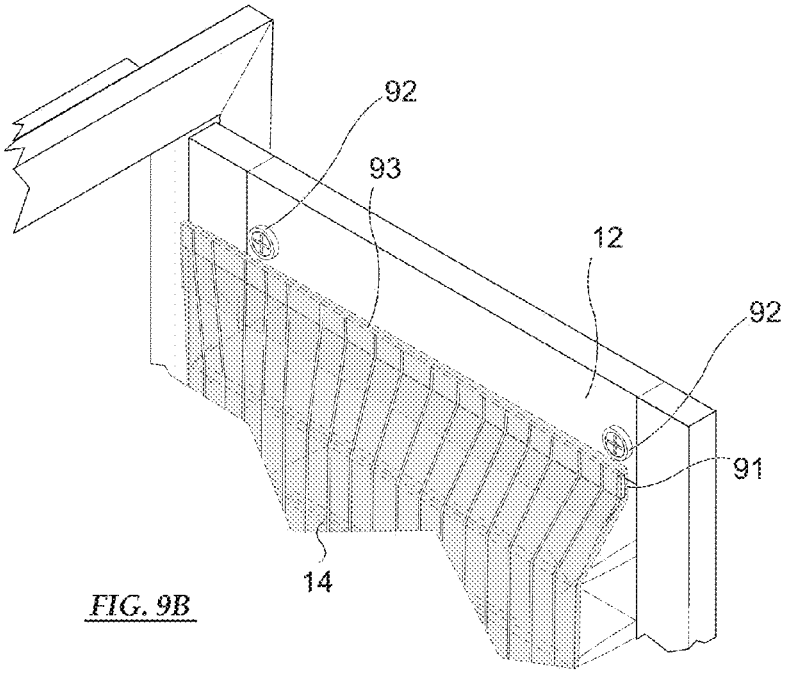
Figure 9C:
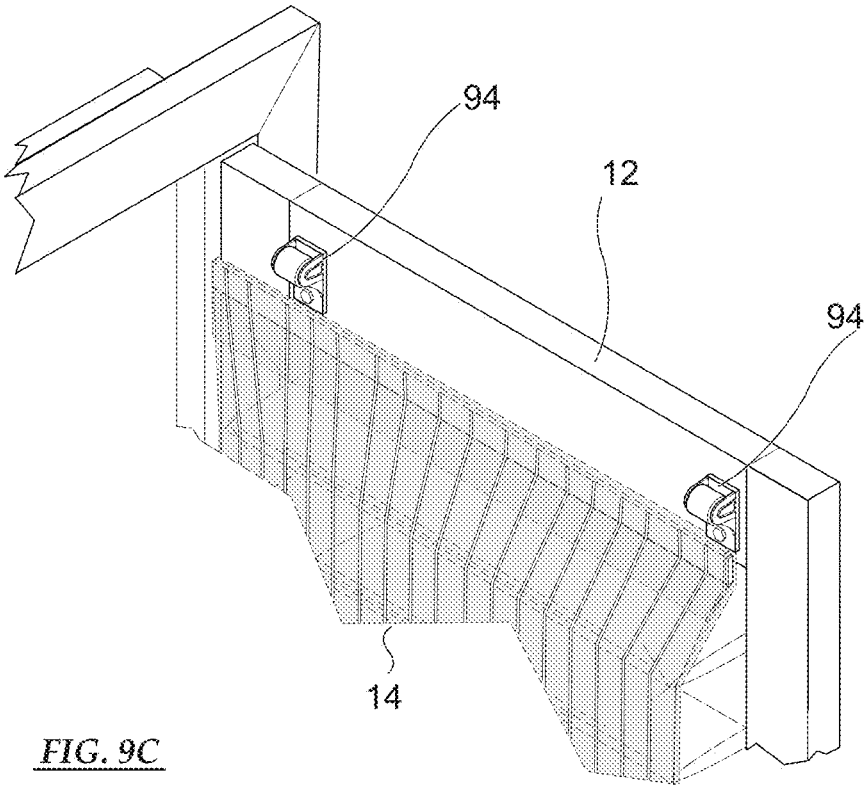

With reference to FIGS. 9A through 9C, an alternative embodiment of the present invention is depicted. The presized fabric 14 could be folded over and sewn forming a sleeve 93 for a spline 91, the spline 91 comprising magnetic material configured to be attracted to complementary metal material 92 replacing the hook and loop fasteners 51. The metal material 92 could also be magnetic material of opposite polarity of the spline 91 magnetic material. Also, alternatively, a drapery rod and complementary hooks could be used in this manner as desired by a user contributing to an aesthetically pleasing design. Referring to FIG. 9C, a plastic magnet holder 94 is depicted. The plastic magnet holder 94 holds a metal material or a magnetic material 92 to magnetically couple to the spline 91.

It should be understood, of course, that the foregoing relates to exemplary embodiments of the invention and that modifications may be made without departing from the spirit and scope of the invention as set forth in the following claims.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Solar Shutter as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. A window shutter comprising:

a four-sided flame for positioning about a window frame;

a plurality of slats rotatably coupled to the frame, the plurality of slats having an open position and a closed position;

a covering fabric, removably coupled to the frame, the covering fabric providing at least a partial filter for light transmission through the window shutter; and a vertical link bar coupled to a leading edge of each of the plurality of slats for transitioning the plurality of slats from the open position to the closed position and wherein in the open position the covering fabric is made to be taut due to a horizontal position of the slats wherein further the covering fabric touches an opposite edge with respect to the leading edge of each of the plurality of slats; and four holes drilled at respective corners of the frame; four circular magnets each at a respective of the four holes; and a pair of ferromagnetic hem bars sewn into a respective top and a bottom of the covering fabric, wherein each of the pair corresponds to two of the four circular magnets.

2. The window shutter of claim 1, wherein the four-sided frame comprises an outer frame having four sides and an inner frame having four sides, wherein the inner frame is hingedly connected to the outer frame and wherein the covering fabric is removably coupled to the inner frame, and further when the plurality of slats are in the closed position then the covering fabric is slacked.

3. The window shutter of claim 1, the covering fabric removably coupled to the frame further comprising:

a plurality of groves carved out of an edge of each of the plurality of slats; and a plurality of spline teeth coupled to the covering fabric and each of the plurality of spline corresponding to one of each of the plurality of grooves.

4. A window shutter comprising:

a four-sided frame for positioning about a window frame;

a plurality of slats rotatably coupled to the frame, the plurality of slats having an open position and a closed position;

a covering fabric, removably coupled to the frame, the covering fabric providing at least a partial filter for light transmission through the window shutter; and four holes drilled at respective corners of the frame;

four circular magnets each at a respective of the four holes; and a pair of ferromagnetic hem bars sewn into a respective top and a bottom of the covering fabric, wherein each of the pair corresponds to two of the four circular magnets.

5. The window shutter of claim 4, wherein the four-sided frame comprises an outer frame having four sides and an inner frame having four sides, wherein the inner frame is hingedly connected to the outer frame and wherein the covering fabric is removably coupled to the inner frame, further wherein when the plurality of slats are in the fully open position then the covering fabric is taut and further when the plurality of slats are in the closed position then the covering fabric is slacked.

6. The window shutter of claim 4, further comprising:

a vertical link bar coupled to a leading edge of each of the plurality of slats for transitioning the plurality of slats from the open position to the closed position and wherein in the open position the covering fabric is made to be taut due to a horizontal position of the slats wherein further the covering fabric touches an opposite edge with respect to the leading edge of each of the plurality of slats.

7. The window shutter of claim 4, the covering fabric removably coupled to the frame further comprising:

a plurality of groves carved out of an edge of each of the plurality of slats; and a plurality of spline teeth coupled to the covering fabric and each of the plurality of spline corresponding to one of each of the plurality of grooves.

* * * * *